US011761356B2

(12) United States Patent
Ernst et al.

(10) Patent No.: US 11,761,356 B2
(45) Date of Patent: Sep. 19, 2023

(54) INTERNAL COMBUSTION ENGINE FOR A MOTOR VEHICLE, HAVING A CONTROL UNIT FOR ALIGNING A CAMSHAFT AND METHOD FOR OPERATING SUCH AN INTERNAL COMBUSTION ENGINE

(71) Applicant: Daimler AG, Stuttgart (DE)

(72) Inventors: Johannes Ernst, Baden-Baden (DE); Franz Huber, Kirchheim (DE); Jochen Hufendiek, Stuttgart (DE); Christian Lorenz, Fellbach (DE); Tilmann Roemheld, Waiblingen (DE); Frank Strauss, Notzingen (DE); Ruediger Weiss, Winnenden (DE); Hardy Weymann, Oberndorf (DE)

(73) Assignee: Daimler AG, Stuttgart (DE)

( * ) Notice: Subject to any disclaimer, the term of this patent is extended or adjusted under 35 U.S.C. 154(b) by 157 days.

(21) Appl. No.: 17/270,394

(22) PCT Filed: Aug. 8, 2019

(86) PCT No.: PCT/EP2019/071292
§ 371 (c)(1),
(2) Date: Feb. 22, 2021

(87) PCT Pub. No.: WO2020/038727
PCT Pub. Date: Feb. 27, 2020

(65) Prior Publication Data

US 2021/0388741 A1 Dec. 16, 2021

(30) Foreign Application Priority Data

Aug. 23, 2018 (DE) ..... 10 2018 006 666.6

(51) Int. Cl.
*F01L 1/24* (2006.01)
*F01L 1/047* (2006.01)
(Continued)

(52) U.S. Cl.
CPC ..... *F01L 1/24* (2013.01); *F01L 1/047* (2013.01); *F01L 1/08* (2013.01); *F01L 13/08* (2013.01)

(58) Field of Classification Search
CPC ..... F01L 1/24; F01L 1/047; F01L 1/08; F01L 13/08; F01L 13/0036; F02D 41/042;
(Continued)

(56) References Cited

U.S. PATENT DOCUMENTS

2003/0019455 A1 1/2003 Onozawa et al.
2006/0016411 A1 1/2006 Flanagan et al.
(Continued)

FOREIGN PATENT DOCUMENTS

CN 1399060 A 2/2003
CN 1991135 A 7/2007
(Continued)

OTHER PUBLICATIONS

PCT/EP2019/071292, International Search Report dated Nov. 25, 2019 (Three (3) pages).
(Continued)

*Primary Examiner* — Devon C Kramer
*Assistant Examiner* — Kelsey L Stanek
(74) *Attorney, Agent, or Firm* — Crowell & Moring LLP

(57) ABSTRACT

An internal combustion engine for a motor vehicle includes a crankshaft, a camshaft, a cylinder, a piston movably disposed in the cylinder and coupled to the crankshaft for driving the crankshaft, a first gas exchange valve which is assigned to the cylinder, a first valve clearance compensation device, where via the first valve clearance compensation device the first gas exchange valve is displaceable between a first open position and a first closed position by a first cam of the camshaft, and a control unit. The control unit is configured to align the camshaft such that the first valve
(Continued)

clearance compensation device is pressure-loaded in the idle state of the crankshaft by a plateau area assigned to the first cam to hold the first gas exchange valve in the first open position.

6 Claims, 3 Drawing Sheets

(51) Int. Cl.
*F01L 1/08* (2006.01)
*F01L 13/08* (2006.01)

(58) Field of Classification Search
CPC .. F02D 41/0005; F02D 41/02; F02D 13/0203; F02D 13/0276; F02D 2041/002; F02D 2250/41
USPC ..... 123/90.16
See application file for complete search history.

(56) References Cited

U.S. PATENT DOCUMENTS

| | | | | |
|---|---|---|---|---|
| 2012/0260873 | A1* | 10/2012 | Dietel | F01L 13/0047 123/90.15 |
| 2016/0084119 | A1 | 3/2016 | Sugiura et al. | |
| 2020/0102898 | A1* | 4/2020 | Masukake | F02D 37/02 |
| 2021/0172388 | A1* | 6/2021 | Hauptvogel | F02D 41/0005 |
| 2022/0268226 | A1* | 8/2022 | Hill | F02D 41/042 |

FOREIGN PATENT DOCUMENTS

| | | | |
|---|---|---|---|
| CN | 101672205 | A | 3/2010 |
| CN | 103003533 | A | 3/2013 |
| CN | 108350847 | A | 7/2018 |
| DE | 103 42 703 | B4 | 4/2005 |
| DE | 10 2008 039 007 | A1 | 2/2010 |
| DE | 10 2012 215 869 | A1 | 3/2014 |
| DE | 10 2016 013 370 | A1 | 5/2018 |
| EP | 2 998 526 | A1 | 3/2016 |
| JP | 2011-185277 | A | 9/2011 |

OTHER PUBLICATIONS

German-language German Office Action issued in German application No. 10 2018 006 666.6 dated May 8, 2019 (Eight (8) pages).
Chinese-language Chinese Office Action issued in Chinese application No. 201980055043.0 dated Dec. 14, 2021 (Five (5) pages).

* cited by examiner

INTERNAL COMBUSTION ENGINE FOR A MOTOR VEHICLE, HAVING A CONTROL UNIT FOR ALIGNING A CAMSHAFT AND METHOD FOR OPERATING SUCH AN INTERNAL COMBUSTION ENGINE

BACKGROUND AND SUMMARY OF THE INVENTION

The invention relates to an internal combustion engine for a motor vehicle. A further aspect of the invention relates to a method for operating an internal combustion engine for a motor vehicle.

From DE 10 2016 013 370 A1, an internal combustion engine device is known, which is provided to perform a direct start, having several cylinders which each have at least one valve. At least one of the cylinders is designed as a direct start cylinder. The internal combustion engine device comprises at least one valve train device which is provided to actuate the valves of at least one cylinder in a first position with a first valve stroke, and in a second position at least with a second valve stroke designed as a decompression stroke. The valve train device is provided to form different decompression strokes for the valves of different cylinders.

US 2006/0016411 A1 describes a system for stopping an engine shaft in a combustion engine after the combustion engine has been stopped at a predetermined angular position of the shaft with respect to the engine valves. The system comprises a sensor for detecting the angular position of the shaft, a programmable electronic motor control module in electrical connection with the sensor, and a shaft positioning mechanism responsive to the motor control module to cause the shaft to stop at the predetermined angular position.

From DE 103 42 703 B4, a method for starting a multi-cylinder internal combustion engine is known. When a starting process is requested, the position of at least one piston in at least one associated cylinder is determined, wherein fuel is injected into a combustion chamber of the cylinder or cylinders of the piston, which is or are in the working cycle, and wherein a fuel/gas mixture is ignited in the at least one cylinder which is in the working cycle, and the piston or pistons of the further cylinder are set in a forward movement via a crankshaft coupling the pistons. In at least one cylinder located in a compression stroke, a decompression valve is opened to reduce the resistance of the movement of the pistons.

The object of the present invention is to create an internal combustion engine and a method of the type mentioned above, by means of which a particularly low-effort starting of the internal combustion engine from standstill can be achieved.

A first aspect of the invention relates to an internal combustion engine for a motor vehicle, having a crankshaft, having a camshaft, having a first cylinder, in which a first piston of the internal combustion engine coupled to the crankshaft for driving the latter is moveably accommodated, having a first gas exchange valve which is associated with the first cylinder, having a hydraulic, first valve clearance compensation device via which the first gas exchange valve can be displaced between a first open position and first closed position by means of a first cam of the camshaft. The camshaft can be coupled directly or indirectly to the crankshaft and can thus be driven via the crankshaft. The first gas exchange valve can be formed as a first inlet valve, through which fresh air can flow from at least one inlet channel of the internal combustion engine into a first combustion chamber, which is at least partially limited by the first cylinder and the first piston. The hydraulic, first valve clearance compensation device can generally also be abbreviated as first HVA.

In order to enable a particularly low-effort starting of the internal combustion engine from standstill, it is provided in accordance with the invention that the internal combustion engine comprises a control unit which is set up to control at least one change of state of the crankshaft from an operating state in which the crankshaft rotates, into an idle state in which the crankshaft is stationary, to align the camshaft in such a way that the first valve clearance compensation device is pressure-loaded in the idle state by means of a plateau area assigned to the first cam, which is designed as a plateau cam, and thereby holds the first gas exchange valve in the first open position. This is advantageous since, due to the first open position of the first gas exchange valve, which is pressure-loaded and correspondingly depressed by the plateau area of the first cam ("plateau cam") of the camshaft when the internal combustion engine is started (when the crankshaft accelerates from its resting state into the operating state), an at least partial intake of gas or combustion air from the first cylinder via the gas exchange valve located in the first open position can occur, whereby a correspondingly low torque of the first cylinder prevents the starting of the internal combustion engine. In other words, the torque which makes starting the internal combustion engine more difficult, for example when compressing the gas contained in the first cylinder in a compression stroke, can be avoided, whereby starting the internal combustion engine from standstill can occur in a correspondingly simple and low-effort manner. Furthermore, it is particularly advantageous that the pressure loading of the first valve clearance compensation device at least largely or even completely prevents a torque loading on the camshaft by means of the plateau area of the first cam when the internal combustion engine is at a standstill (and thus in the idle state of the crankshaft). In other words, ideally no torque is applied to the camshaft from the first cam of the first cylinder when the hydraulic first valve clearance compensation device is pressure-loaded by means of the plateau area of the first cam.

The plateau area is to be understood as an area of the first cam which is at least substantially flat and thus at least largely gradient-free. Preferably, the gradient of a cam contour of the first cam on the plateau area is the value "0" at least in one plateau zone of the plateau area. In other words, the cam contour on the plateau zone is preferably flat and therefore without gradient. The plateau area can therefore preferably be shaped in such a way that, at least in the plateau zone, there is no change in the lift of the first gas exchange valve, as long as the first cam on its plateau area, in particular in the plateau zone, acts on the hydraulic, first valve clearance compensation device, i.e., pressure-loads the latter. The plateau area can preferably be as wide as possible, wherein the plateau zone can extend over a crank angle of 85° KW, for example. The plateau zone extends over a crank angle range of from 415° KW to 500° KW, wherein the respective work cycles (intake cycle, compression cycle, combustion cycle, exhaust cycle) extend over two complete rotations of the crankshaft, i.e., over a range of from 0° KW to 720° KW. Preferably, the plateau zone extends over a crank angle of 65° KW in a crank angle range of from 435° KW to 500° KW.

Due to the plateau area, the first gas exchange valve as a whole can be held in the first open position in the area of the expected shutdown position of the internal combustion engine, i.e., the expected crankshaft position of the crankshaft at constant stroke, such that, due to the open (in the first open position) first gas exchange valve at standstill, as little torque as possible acts on the camshaft. This also contributes to a particularly low-effort starting of the internal combustion engine.

In an advantageous development of the invention, the control unit is set up to align the camshaft in such a way that the first valve clearance compensation device in the idle state of the crankshaft at least substantially abuts a central portion of the plateau area of the first cam. This is advantageous because it prevents any backward or forward swinging of the camshaft and crankshaft during shutdown and instead allows a defined respective position of the camshaft and crankshaft to be assumed and maintained.

In a further advantageous development of the invention, the internal combustion engine comprises a second gas exchange valve which is assigned to the first cylinder, and a hydraulic, second valve clearance compensation device by means of which the second gas exchange valve can be displaced between a second open position and a second closed position by means of a second cam of the camshaft. The second gas exchange valve can be designed as a second inlet valve. This is advantageous because the second gas exchange valve can be used in addition to the first gas exchange valve to enable a particularly demand-oriented charge exchange in the first cylinder.

The first cam is designed as a "plateau cam" and can preferably be designed alongside a third cam, a so-called "filling cam", wherein the first cam has a lower valve stroke overall than the third cam. The third filling cam enables the first cylinder to be filled with a particularly large quantity (mass flow) of fresh air, which is available for combustion and shifts the first gas exchange valve between a third open position and a third closed position. The third cam ("filling") corresponds to the known cams for inlet valves for the combustion operation. The first cam ("plateau"), on the other hand, is used in particular to reduce the torque of the first cylinder during starting and to fill the first cylinder with sufficient fresh air for a combustion operation in the low load range and/or at low rotational speeds and includes the plateau area for a torque-free shutdown of the internal combustion engine. By means of the third cam, the first gas exchange valve can be shifted to the third open position during fired operation of the internal combustion engine in order to cause a favorable inflow of the desired amount of fresh air for fuel combustion. Towards higher loads and/or rotational speeds, it is possible to switch over from the first cam to the third cam and operate the first gas exchange valve accordingly.

Alongside the second cam, a further, fourth cam is provided. The fourth cam is designed as a "filling cam" analogous to the third cam and is switched over to higher rotational speeds with the third cam after the starting operation or a combustion operation with a low rotational speed. The fourth cam has a fourth open position and a fourth closed position, which is designed analogously to the third open position and third closed position.

Switching over from the first cam (plateau) and from the second cam (decompression) to the respective adjacent third cam and fourth cam (filling) can be done at a rotational speed in the range of 1000 rpm of the internal combustion engine.

In a further advantageous development of the invention, the second valve clearance compensation device on the second cam is in stroke-free contact, while the first valve clearance compensation device is pressure-loaded by means of the plateau area in the idle state and thus the first gas exchange valve is held in the first open position. In other words, the hydraulic, second valve clearance compensation device (HVA) is not pressurized by the second cam in such a way that the second valve clearance compensation device opens the second gas exchange valve, i.e., moves it into a second open position assigned to the second gas exchange valve or holds it in this open position. The second valve clearance compensation device (HVA) is located in the shutdown position of the internal combustion engine in the area of a base circle of the second cam, which means that the second gas exchange valve remains in its second closed position while the first gas exchange valve remains in its first open position.

This is based on the knowledge that the first HVA or the second HVA is usually designed as a spring-operated compensating piston and can be arranged between the respective gas exchange valves and, if necessary, other valve actuation devices which are known per se and operated by the respective cams, which may include rocker arms, drag levers, cup tappets and the like. The compensating piston is extended by means of a spring force of the spring and reduces a valve clearance of the respective gas exchange valves to the value "zero" during engine running (operation) of the internal combustion engine. The retraction of the compensating piston is delayed in a controlled manner by means of engine oil drawn in when the compensating piston is extended and by means of a check valve. When the engine is at a standstill (idle state of the crankshaft) and the respective gas exchange valve is open (for example, in the first open position of the first gas exchange valve), the engine oil is at least partially pressed out of the respective HVA (for example from the hydraulic, first valve clearance compensation device) and the respective gas exchange valve moves in the direction of a valve seat assigned to it (in which the respective gas exchange valve is in its closed position). If one of the respective gas exchange valves is in a respective filling or intake phase of the first cylinder during engine standstill, i.e., the first cam acts with its plateau area on the first gas exchange valve, the respective, smaller valve stroke of the first cam is further reduced compared to a valve stroke of the third filling cam of the respective gas exchange valve, wherein the respective gas exchange valve is nevertheless not completely closed. The valve stroke of the first gas exchange valve in the first open position during engine standstill is then smaller than the valve stroke of the first gas exchange valve in the first open position in the combustion operation, but remains open. When the engine is restarted (acceleration of the crankshaft from idle state to operating mode), a torque of the first cylinder preventing the engine start is reduced, which facilitates the starting process.

In a further advantageous development of the invention, the second gas exchange valve can be operated by means of the second cam using the second valve clearance compensation device in such a way that a decompression of the first cylinder can be effected. This is advantageous, since this allows a filling and a decompression of the first cylinder to be distributed to several valve trains with correspondingly two gas exchange valves per cylinder. In this way, it is possible to adjust the filling and decompression settings in a particularly flexible manner.

The second cam can be designed as a "decompression cam" with a decompression valve lift, wherein the decompression valve lift can cause a smaller valve stroke of the second gas exchange valve than is the case with the plateau area of the first cam. The decompression valve lift can be positioned between the bottom dead center (BDC) of the first piston and its top ignition dead center (TDC) as close as possible to a maximum piston speed of the first piston, since the largest piston path of the first piston and thus the highest possible compression ratio takes place in this area. A maximum value of the decompression valve stroke can preferably be less than 3.0 mm, and an opening width (elevation width) of a cam elevation of the second cam can preferably be a value of less than 180° KW. The second gas exchange valve can preferably be closed in the shutdown position of the internal combustion engine (idle state and idle position of the crankshaft), such that an unfavorable compression of the second HVA is prevented. The first gas exchange valve and the second gas exchange valve have different open and closed positions, wherein in the first open position of the first gas exchange valve, the second gas exchange valve is in the second closed position, and in the second open position of the second gas exchange valve, the first gas exchange valve is in the first closed position.

The first cam ("plateau cam") can favorably enable the internal combustion engine to output power with the combustion as the rotational speed of the crankshaft increases, for example from rotational speed values of the rotational speed of greater than or equal to 500 rpm. Here, the second cam ("decompression cam") is not intended to support the filling of the combustion chamber of the first cylinder, but only to effect decompression at low rotational speeds, for example at rotational speed values of the rotational speed below 500 rpm.

This can be achieved in a particularly advantageous way by designing the small "decompression cam" (second cam) with regard to its stroke in such a way that it does not stall at low rotational speeds (low rotational speeds of the crankshaft) in towing operation of the internal combustion engine due to low speeds of the gas flowing out of the first cylinder during the charge exchange, on the other hand, it stalls with increasing engine speed (higher rotational speeds of the crankshaft) due to the increasing speeds (of the gas) and thus a cylinder filling flowing out again (due to the outflowing gas) becomes correspondingly smaller. The "plateau cam" is designed in such a way that no supercritical pressure conditions occur and the cylinder filling is substantially maintained even with increasing engine speed. As a result, a combustion is achieved with increasing torque output from the crankshaft of the internal combustion engine with increasing engine speed (rotational speed of the crankshaft).

A second aspect of the invention relates to a method for operating an internal combustion engine for a motor vehicle, which comprises a crankshaft, a camshaft, a first cylinder in which a first piston of the internal combustion engine coupled to the crankshaft for driving the latter is moveably accommodated, as well as a first gas exchange valve associated with the first cylinder and a hydraulic, first valve clearance compensation device via which the first gas exchange valve can be displaced between a first open position and a first closed position by means of a first cam of the camshaft.

According to the invention, the internal combustion engine comprises a control unit, by means of which, at least during a change of state of the crankshaft from an operating state in which the crankshaft rotates into an idle state in which the crankshaft is stationary, the camshaft is aligned in such a way that the first valve clearance compensation device is pressure-loaded in the idle state by means of a plateau area assigned to the first cam designed as a plateau cam, and the first gas exchange valve is thereby held in the first open position. The features presented in connection with the internal combustion engine according to the first aspect of the invention as well as their advantages apply accordingly to the method according to the second aspect of the invention and vice versa.

Further advantages, features and details of the invention emerge from the following description of a preferred exemplary embodiment and from the drawings. The features and combinations of features mentioned above in the description as well as the features and combinations of features mentioned in the following description of the figures and/or shown in the figures alone cannot only be used in the combination specified in each case, but also in other combinations or on their own without leaving the scope of the invention.

DETAILED DESCRIPTION OF THE DRAWINGS

FIGS. 1 to 5 serve to illustrate an operation of an internal combustion engine not depicted in more detail here for a motor vehicle also not depicted in more detail here. The internal combustion engine comprises a crankshaft, a camshaft, a first cylinder in which a first piston of the internal combustion engine coupled to the crankshaft for driving the latter is moveably accommodated, a first gas exchange valve which is assigned to the first cylinder, a hydraulic, first valve clearance compensation device via which the first gas exchange valve can be displaced between a first open position and a first closed position by means of a first cam of the camshaft.

In addition, the internal combustion engine comprises a control unit which is set up to align the camshaft, at least during a change of state of the crankshaft from an operating state in which the crankshaft rotates to a rest state in which the crankshaft is stationary, in such a way that the first valve clearance compensation device is pressure-loaded in the idle state by means of a plateau area 11 assigned to the first cam, and thus the first gas exchange valve is held in the first open position. The first cam is designed as a plateau cam.

The control unit is set up to align the camshaft in such a way that the first valve clearance compensation device at least substantially abuts a central section 13 of the plateau area 11 in the idle state of the crankshaft.

In addition, the internal combustion engine comprises a second gas exchange valve, which is assigned to the first cylinder, and a hydraulic, second valve clearance compensation device, via which the second gas exchange valve can be displaced between a second open position and a second closed position by means of a second cam of the camshaft.

The second valve clearance compensation device is in stroke-free contact with the second cam, while the first valve clearance compensation device is pressure-loaded by means of the plateau area 11 in the idle state, and thus the first gas exchange valve is held in the first open position. The second gas exchange valve can be actuated by means of the second cam using the second valve clearance compensation device in such a way that a decompression of the first cylinder can be effected. The second cam is designed as a decompression cam.

The internal combustion engine is designed in this case to perform a so-called "direct start" with particularly low effort, i.e., to start the internal combustion engine solely by combustion energy and thus to accelerate the crankshaft from the idle state to the operating state solely by combustion energy. Furthermore, the internal combustion engine is suitable for a conventional start by means of a starter or an electric motor, for example. The internal combustion engine according to the invention is particularly suitable for starting a hybrid motor vehicle without load.

Figure 1:
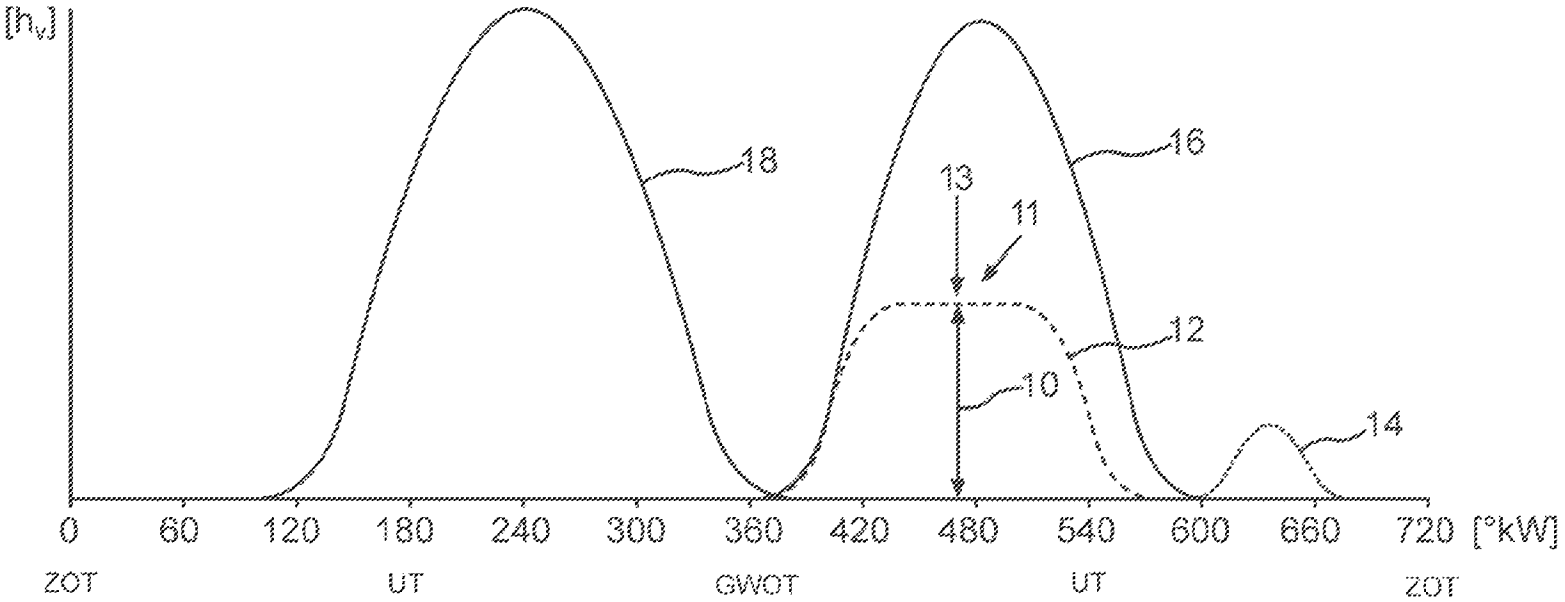
FIG. 1 is a diagram which shows a valve stroke course of a first gas exchange valve as well as a second gas exchange valve over a crank angle course of a crankshaft of an internal combustion engine, wherein the first gas exchange valve and the second gas exchange vale are assigned to a first cylinder of the internal combustion engine.
Figure 2:
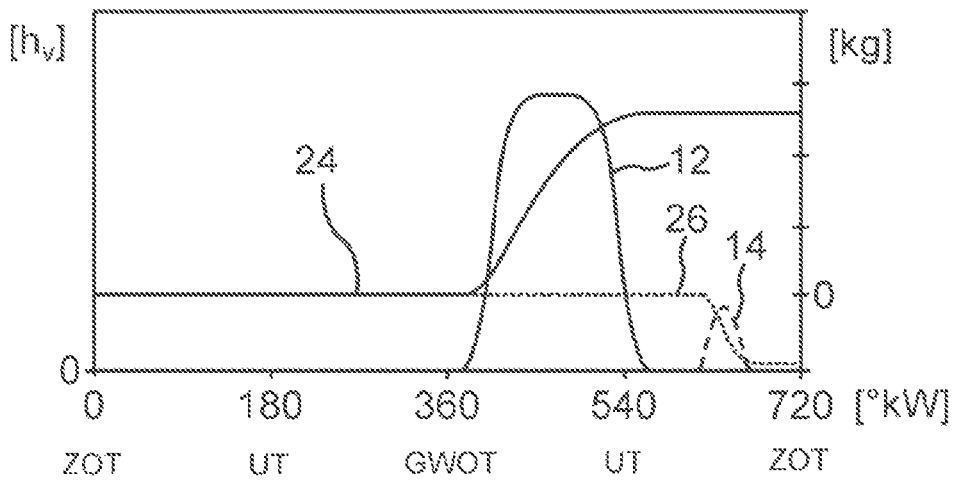
FIG. 2 is a further diagram which shows the respective valve stroke course of the first and second gas exchange valve and a respective mass of air flowing into the first cylinder and air flowing out via the crank angle course of the crankshaft during a charge exchange at a rotational speed of the crankshaft of less than 500 rpm.

In order to carry out the start and in particular the direct start, i.e., the starter-free acceleration (acceleration without starter) of the crankshaft of the internal combustion engine from the idle state to the operating state, the crankshaft is shifted from the operating state to the idle state before the direct start, and in doing so, is stopped by means of the control unit in a position (crankshaft position) in relation to the first cam ("plateau cam") in such a way that a valve actuation (rocker arm, drag lever, cup tappet etc.) is shut down approximately in the center or in a central section 13 of the plateau area 11 and thus in a plateau zone of the plateau area 11, where it results in a constant stroke 10 of the first gas exchange valve. In FIG. 1, this is the case in a crank angle range between approximately 435° KW and 500° KW (crank angle). A corresponding valve stroke course 12 in the combustion operation is plotted as a dashed line in a diagram in FIG. 1, which shows the valve stroke $h_V$ over the crank angle ° KW. The valve stroke course has a corresponding plateau area 11 with its central section 13. The first open position of the first gas exchange valve is substantially between the gas exchange OT (GWOT) at about 360° KW and shortly after the bottom dead centre (BDC) at about 570° KW. In this way, the first gas exchange valve, which is designed as the first inlet valve of the first cylinder, is opened (in the first open position) when the internal combustion engine is shut down (idle state of the crankshaft), and thus compresses the first valve clearance compensation device (first HVA), i.e., in other words pressure-loads it, whereby the first HVA is out of operation. This means that, after the internal combustion engine has been shut down, a valve stroke of the first gas exchange valve is smaller than the stroke 10 by the amount of the compressed first valve clearance compensation device. This does not pose a problem for starting the internal combustion engine in the form of direct starting, since the first inlet valve remains wide open during the intake stroke despite compressed first HVA.

Furthermore, by shutting down the internal combustion engine in such a way that the first HVA is depressed (pressure-loaded) by the plateau area 11 and thus the first gas exchange valve is held in the first open position, no compression-related torque is introduced via the camshaft into the crank drive and thus the crankshaft, especially as the first gas exchange valve does not act or press on any flank of the first cam via the valve actuation. Overall, any backward or forward swinging of the crankshaft of the internal combustion engine during shutdown can be avoided and a defined position of the camshaft and the crankshaft can be assumed.

The valve actuation of the first gas exchange valve resulting from the kinematic coupling of the camshaft or the first cam and the first HVA supports the starting (direct start) of the internal combustion engine, i.e., the acceleration of the crankshaft from its idle state at the transition from the plateau area 11 to a falling flank of the first cam, such that the acceleration of the crankshaft can take place with an introduction of a torque via the camshaft to the crankshaft and accordingly the starting of the internal combustion engine can be designed to be particularly low-effort.

The second gas exchange valve, which is designed as a second inlet valve assigned to the first cylinder, is still closed when the internal combustion engine is shut down, since the second inlet valve is only opened between 570 and 630° KW and closed between 630° KW and 690° KW by means of the second cam designed as a "decompression cam". As can be seen in FIG. 1 by means of a valve stroke course 14 assigned to the second inlet valve, a second open position can substantially occur between 600° KW and 675° KW. The second open position of the second gas exchange valve only occurs in the first closed position of the first gas exchange valve. The first open position of the first gas exchange valve occurs in the second closed position of the second gas exchange valve.

The second inlet valve opens for the decompression in the compaction cycle, i.e., when the first piston is located between its bottom dead canter (BDC) at 540° KW and its top ignition dead centre (TDC) at 720° KW, as is also shown in FIG. 1. The hydraulic, second valve clearance compensation device (second HVA) of the second inlet valve is therefore unloaded when the internal combustion engine is switched off and therefore in operation when the internal combustion engine is restarted (direct start), especially since no engine oil has been previously forced out of the hydraulic, second HVA, which allows the decompression of the (compressing) first cylinder to take place during start/restart of the internal combustion engine.

By way of example, if the internal combustion engine is designed as a 4-cylinder engine having an ignition sequence 1-3-4-2 (first cylinder-third cylinder-fourth cylinder-second cylinder), the decompression cam (second cam) of the cylinder "2" (second cylinder) acts on the second inlet valve of this cylinder "2", since the ignition distance is 180° KW and thus the plateau area 11 of the first cam ("plateau cam") for the first inlet valve of the cylinder "1" and the decompression cams (second cam) of the second inlet valve of the cylinder "2" coincide. Thus, the first inlet valve of the cylinder "1" is opened (in the first open position) when the internal combustion engine is switched off by the plateau area 11 of the "plateau cam" and is fired when the internal combustion engine is (directly) started, whereby ignitable fuel-air mixture contained in the first cylinder (cylinder "1") is ignited, while in cylinder "2" (which is ignited in the fourth position in the ignition sequence and thus the last of the four cylinders to be ignited), the corresponding decompression cam acts on the second inlet valve of the cylinder "2". However, the negative influence of the compressed, second HVA for this second inlet valve of the cylinder "2" is negligible for the direct start of the internal combustion engine, since there is a residual stroke of this second inlet valve (i.e., there is a decompression effect), and the cylinder "2" has already been at least partially decompressed when the internal combustion engine is switched off.

If the internal combustion engine is designed as a 6-cylinder engine, for example, this problem does not arise, since in this case, the ignition distance (between the total of 6 cylinders) is 120° KW, and thus the "filling cam" of the first cylinder and the "decompression cam" of the second cylinder coincide.

After the internal combustion engine has been started, i.e., in other words the camshaft from the idle state into the operating state, the inlet-side valve train is switched over, for example, when the rotational speed of the internal combustion engine is in the range of 1000 rpm. In doing so, the first cam and simultaneously the second cam are switched over to third and fourth cams respectively arranged in parallel to the two cams, resulting in an inlet valve stroke course 16 of the first gas exchange valve and the second gas exchange valve, which is illustrated in FIG. 1 by a solid line.

An exhaust-side valve train assigned to the first cylinder remains unaffected, which can be seen in an exhaust valve stroke course 18 shown in FIG. 1.

The inlet-side valve train can be operated by means of a so-called "Camtronic system", for example, and thus the valve stroke course 12, 14 and/or the inlet valve stroke course 16 can be varied. Different inlet-side cams are provided for the first and second inlet valve in a starting or decompression mode with a plateau cam (with its valve stroke course 12) and a decompression cam (with its valve stroke course 14) and, for example, two identical cams without respective plateau or decompression areas for the normal combustion operation. By way of example, the two third and fourth cams arranged next to a plateau cam and a decompression cam are designed as filling cams and each have the valve stroke course 16.

FIGS. 2 to 5 show the respective first and second open positions and the corresponding first and second closing positions of the first gas exchange valve and the second gas exchange valve with the respective opening and closing times of the respective inlet valve stroke courses 12 and 14.

FIGS. 2 to 5 serve to illustrate that the plateau cam in conjunction with the decompression cam can cause changed flow behaviour compared to decompression devices previously known from the prior art.

On the respective axes of the diagrams shown in FIG. 2 to FIG. 5, in addition to the valve stroke $h_v$ and the crank angle ° KW, the integrated mass flow of fresh air in kg, as well as the speed—expressed by the Mach number Ma—of the gas (air) flowing during charge exchange, are also specified. In the case of previously common strokes of decompression devices, gas exchange valves were opened in each case to such an extent that there was no or only a slight influence on the flow of the charge of the first cylinder exiting the combustion chamber.

Figure 3:
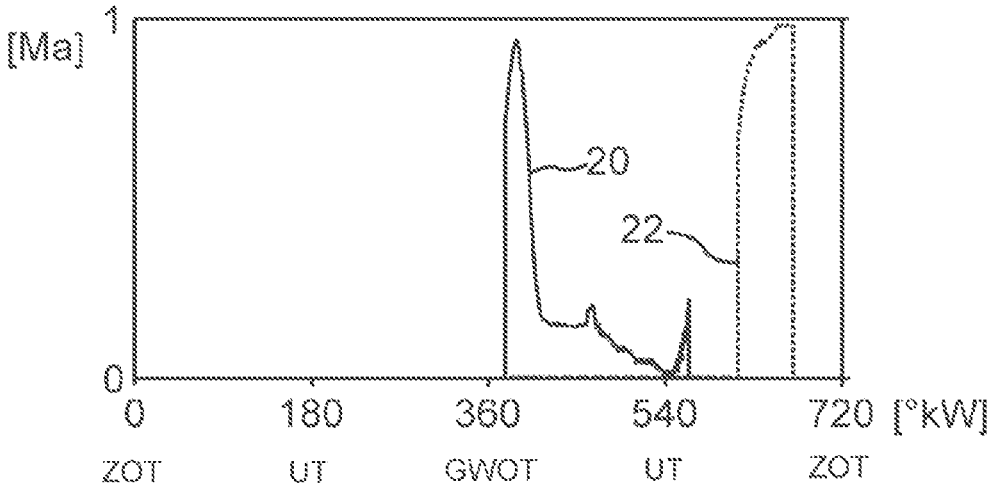
FIG. 3 is a further diagram which shows a speed of the air flowing into the first cylinder and the air flowing out via the crank angle course of the crankshaft during charge exchange at a rotational speed of the crankshaft of less than 500 rpm.
Figure 4:
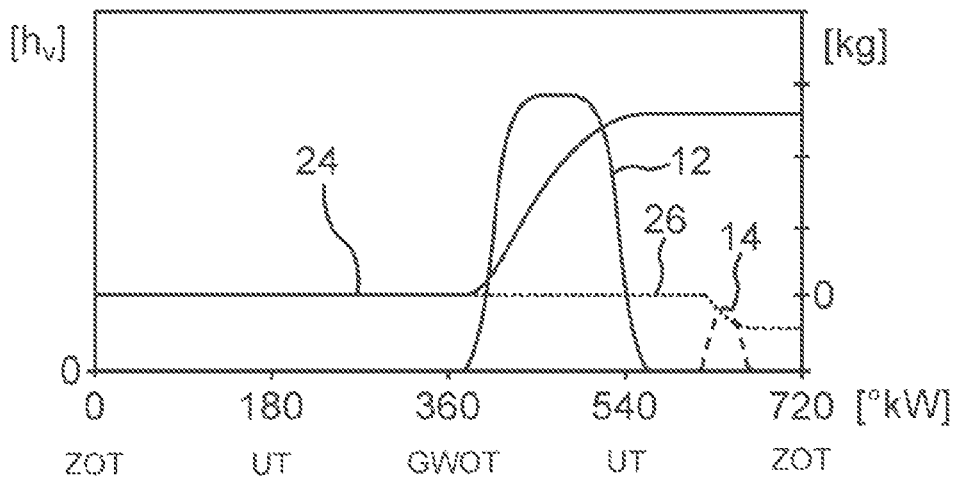
FIG. 4 is a further diagram which shows the respective valve stroke course of the first and second gas exchange valve and the respective masses of air flowing into the first cylinder and air flowing out via the crank angle course of the crankshaft during the charge exchange at a rotational speed of the crankshaft of greater than or equal to 500 rpm.
Figure 5:
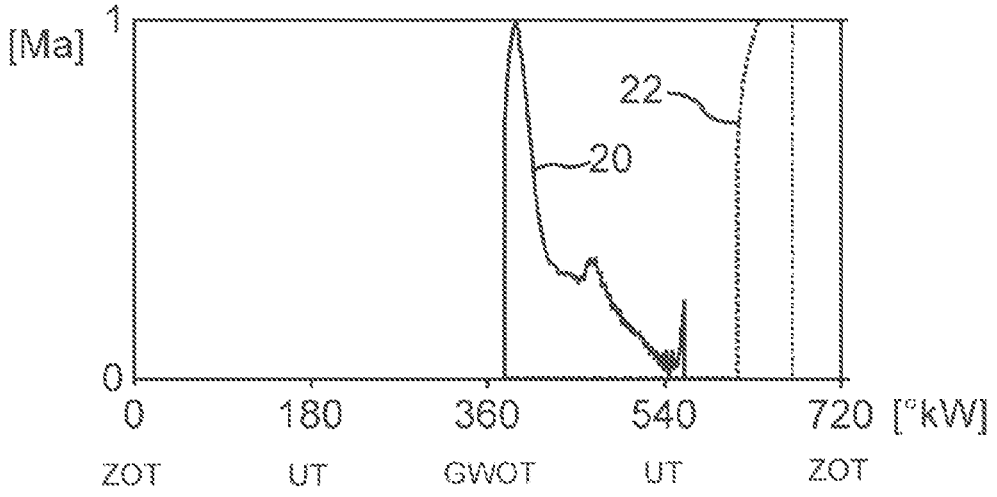
FIG. 5 is a further diagram which shows the speed of the air flowing into the first cylinder and the air flowing out via the crank angle course of the crankshaft during charge exchange at the rotational speed of the crankshaft of greater than or equal to 500 rpm.

With corresponding decompression strokes by means of the second cam, decompression can be performed at low rotational speeds (less than 500 rpm, see FIG. 2), as expressed by the valve stroke course 14. An integrated mass flow 24 is depicted with a solid line, as generated by the valve stroke course 12 of the plateau cam. The first gas exchange valve is moved from its first closed position to its first open position, after which the mass flow 24 increases from zero to a positive value of zero, different from zero. Subsequently, the first gas exchange valve is moved back into its first closed position. During the first closed position of the first gas exchange valve, the second gas exchange valve is moved from its second closed position to its second open position, after which a mass flow 26 is generated by the valve stroke course 14 of the decompression cam, with a negative value different from zero. Subsequently, the second gas exchange valve is then moved back to its second closed position. As depicted by the dotted line, a negative integrated mass flow 26 exits the cylinder again via the second gas exchange valve. The total mass of fresh air remaining in the cylinder is the sum of the two mass flows 24 and 26 after the open position of the second gas exchange valve in its second closed position. As can be seen in FIG. 3, the valve stroke course 12 of the first gas exchange valve has a speed course 20 of the inflowing fresh air. During decompression (valve stroke course 14) by means of the second cam, the Mach number 1 of the air flowing out of the cylinder is not reached (course 22). At higher rotational speeds (greater than 500 rpm), the decompression effect decreases and compression is carried out in the first cylinder to such an extent that ignition is possible. As can be seen in FIG. 4, the inflowing fresh air (mass flow 24) has a similar course as in FIG. 2. However, the mass flow 26 of the air flowing out of the cylinder (decompression) generated by the valve stroke lift 14 significantly decreases. The fresh air remaining in the cylinder increases, such that a sufficient compression is achieved for a combustion of fuel in the first cylinder, whereby fuel injected into the first cylinder can ignite and combust. As can be seen in FIG. 5, the valve stroke course 12 of the first gas exchange valve has, at higher rotational speeds, a speed profile 20 of inflowing fresh air which is higher than at low rotational speeds (FIG. 3). During decompression (valve stroke course 14) by means of the second cam, the Mach number 1 is exceeded (course 22). In this case, the flow is blocked during decompression due to the super critical speed itself and the mass flow 26 of outflowing fresh air via the second gas exchange valve of the first cylinder decreases with the same valve stroke course 14. The integrated mass flows 24 shown in FIGS. 2 and 4 do not change significantly in the example shown at rotational speeds in the range of 500 rpm.

The internal combustion engine according to the invention and the method according to the invention ensure that a decompression effect is also present after longer standstill periods of the internal combustion engine.

LIST OF REFERENCE CHARACTERS

10 stroke
11 plateau area
12 valve stroke course
13 central section
14 valve stroke course
16 inlet valve stroke course
18 exhaust valve stroke course
20 speed
22 speed
24 mass flow
26 mass flow

The invention claimed is:

1. An internal combustion engine for a motor vehicle, comprising:

a crankshaft;

a camshaft;

a cylinder;

a piston movably disposed in the cylinder and coupled to the crankshaft for driving the crankshaft;

a first gas exchange valve which is assigned to the cylinder;

a first valve clearance compensation device, wherein via the first valve clearance compensation device the first gas exchange valve is displaceable between a first open position and a first closed position by a first cam of the camshaft;

a shaft positioning mechanism configured to position the camshaft; and a control unit configured to control the shaft positioning mechanism so as to align the camshaft, at least during a change of state of the crankshaft from an operating state in which the crankshaft rotates to an idle state in which the crankshaft is stationary, such that the first valve clearance compensation device is pressure-loaded in the idle state by a plateau area assigned to the first cam to hold the first gas exchange valve in the first open position.

2. The internal combustion engine according to claim 1, wherein the control unit is configured to align the camshaft such that the first valve clearance compensation device abuts a central section of the plateau area in the idle state.

3. The internal combustion engine according to claim 1 further comprising:

a second gas exchange valve which is assigned to the cylinder; and a second valve clearance compensation device, wherein via the second valve clearance compensation device the second gas exchange valve is displaceable between a second open position and a second closed position by a second cam of the camshaft.

4. The internal combustion engine according to claim 3, wherein the second valve clearance compensation device is in stroke-free contact with the second cam while the first valve clearance compensation device is pressure-loaded by the plateau area in the idle state and the first gas exchange valve is held in the first open position.

5. The internal combustion engine according to claim 3, wherein the second gas exchange valve is actuatable by the second cam using the second valve clearance compensation device such that a decompression of the cylinder can be effected.

6. A method for operating the internal combustion engine for a motor vehicle according to claim 1, comprising the step of:

aligning the camshaft by the control unit, at least during the change of state of the crankshaft from the operating state in which the crankshaft rotates to the idle state in which the crankshaft is stationary, such that the first valve clearance compensation device is pressure-loaded in the idle state by the plateau area assigned to the first cam to hold the first gas exchange valve in the first open position.

* * * * *